United States Patent [19]

Holben et al.

[11] 4,363,424

[45] Dec. 14, 1982

[54] QUICK COUPLING DEVICE FOR A GAS PRESSURIZATION SYSTEM

[75] Inventors: Clair D. Holben, Denver, Colo.; Edward L. Jeans, Spartanburg, S.C.

[73] Assignee: Cadbury Schweppes PCL, London, England

[21] Appl. No.: 200,020

[22] Filed: Oct. 23, 1980

[51] Int. Cl.[3] ..... B67D 1/12

[52] U.S. Cl. ..... 222/4; 222/129.3

[58] Field of Search ..... 222/3, 52, 61, 129.1–129.4, 222/478, 981; 137/498, 505, 507; 277/9

[56] References Cited

U.S. PATENT DOCUMENTS

| | | | |
|---|---|---|---|
| 1,079,904 | 11/1913 | Perkins . | |
| 1,427,854 | 9/1922 | Rogers . | |
| 2,310,021 | 2/1943 | Heidbrink | 222/3 X |
| 2,518,894 | 8/1950 | Humbarger et al. | 137/144 |
| 2,524,052 | 10/1950 | Grant . | |
| 2,776,849 | 1/1957 | Homuth | 222/3 |
| 2,809,658 | 10/1957 | Frantz et al. | 137/498 |
| 3,368,923 | 2/1968 | Smith | 136/86 |
| 3,881,636 | 5/1975 | D'Aubreby | 222/129.4 |

*Primary Examiner*—Stanley H. Tollberg
*Attorney, Agent, or Firm*—Kenyon & Kenyon

[57] ABSTRACT

A regulated gas pressurization system for a beverage dispenser which includes a pressure regulator, cylinder valve, and quick coupling apparatus provided for securely connecting the valve and regulator for safe operation. The regulator includes an adjustably biased diaphragm which operates a control valve which regulates the flow of gas from a gas storage cylinder to the beverage dispenser. The adjustment of the biasing force on the diaphragm determines the outlet pressure in the system. A pivotable yoke which is part of the coupling apparatus is placed in a raised position so that the cylinder shutoff valve can be properly aligned with the regulator boss and lowered to a retaining position where a retaining screw can be turned inwardly to move the cylinder valve into rigid coupling position with the regulator. Upon coupling, a poppet within the cylinder valve is opened automatically to allow gas to flow into the regulator. This arrangement permits a short lateral sliding movement for installation of a gas storage cylinder which allows a novice to change the cylinder safely and quickly in a confined space.

23 Claims, 10 Drawing Figures

QUICK COUPLING DEVICE FOR A GAS PRESSURIZATION SYSTEM

DESCRIPTION

1. Technical Field

This invention is directed to a coupling arrangement for a regulator-valve combination for use in gas pressurization systems. It is more specifically directed to a quick coupling apparatus for installing and securing a pressure regulator to a compressed gas storage cylinder for use in a gas pressurized beverage dispensing system.

2. Background of the Invention

Over the years numerous systems have been devised for sealing and storing high pressure gas within a gas storage bottle or cylinder. In most cases, the valve used for sealing the cylinder during transportation and controlling gas flow during use has been a manually operated globe valve which is merely opened or closed in order to dispense the gas contained therein. At the same time, various arrangements have been provided for attaching pressure regulators directly to the storage cylinder so that the gas being utilized is reduced in pressure to a useful level. In most cases, the pressure of the compressed gas stored within the cylinder is extremely high in comparison with the actual system operating pressure so that a large volume of gas can be transported and stored within the cylinder for operational use. In fact, in many cases, due to the high pressure, the gas stored in the cylinder is actually in the liquid state at ambient temperatures. The common regulators used with this type of storage container have threaded connections which are directly connected to the globe valve to provide a coupling of the components. This arrangement appears to be satisfactory if the cylinder can be rigidly supported and if there is a clear area around the cylinder to permit free access for operation and changing of the cylinder.

One of the major problems associated with high pressure gas storage cylinders has been the necessity for rigidly supporting and protecting the cylinder to prevent if from being struck or to keep it from falling over. If either of these situations should occur, the bottle could be severely damaged by the breaking or separation of the bottle valve with a sudden release of the compressed gas stored within. This condition could be dangerous from the standpoint that the separation of the valve can allow the gas to suddenly escape causing the bottle to be propelled as an unguided missile. Another possibility is that a sudden forceful explosion could occur if the cylinder is damaged or fractured.

As is well-known there have been other types of shutoff valves used on gas storage bottles which are available to industry and the public. Some well-known examples are the hand-held, pressurized fire extinguishers, and pressurized cylinders for propane torches. Both of these appliances have valves which are relatively different from the usual compressed gas cylinder. The propane torch and fire extinguisher valves are usually of the spring-loaded, pressure assisted, check-valve type. This is to say that an internal slidable poppet which is biased by a spring, seals the valve and prevents loss of the gas stored within. In addition, the gas pressure within the cylinder also applies a force to the rear surface of the poppet to assist the spring in holding the poppet in the closed position. In the case of the fire extinguisher, usually a lever-type handle is provided for moving an external plunger or shoulder which is provided as part of the poppet in order to move the poppet against the spring and gas pressure to open the valve and release the contents. With a propane torch, the poppet actuation is slightly different in that the nozzle assembly has an internal stem and a threaded coupling whereby as the nozzle is threaded onto the outlet fitting on the cylinder, the stem pushes against the poppet which moves and opens the poppet against the spring and gas forces. In this way, the contents of the bottle is automatically released to a needle control valve in the nozzle which is used to control the flow of gas from the nozzle.

Another well known gas regulator area pertains to scuba equipment which has been in use for a number of years. The most common scuba equipment provides a manual shut-off valve on a gas storage cylinder. The first stage regulator for providing breathing air to the diver includes a rigid yoke for retaining the regulator and tank valve in coupled position. A single abutment type, O-ring sealed coupling is used to join these components. This arrangement is simplistic in that no alignment boss enters a receptacle passageway to easily align and aid in rigidly holding the components in a supportive position. Thus, there is no sliding coupling provided by the presently known scuba regulators.

As can be seen, none of these devices show the automatic sliding coupling provided in the present invention which eliminates many access problems and quickly allows the cylinder and valve to be connected to the regulator in a confined area.

It is interesting to note that the propane bottle gas storage arrangement provides a spring-loaded valve which is similar to the well-known conventional tire air valve which is provided as a unit which is threadly inserted into the tire valve stem. The function of the tire air valve is essentially the same as described above in that an actuator is provided on the external end of the valve poppet which allows the poppet to be opened automatically when the actuator is pushed or contacted by an air fill fitting.

PRIOR ART STATEMENT

The following is a list and brief description of each of the most pertinent patents of which the inventors are aware. These patents are cited as having features which may, in some instances, be similar to certain features of the present invention. It is to be understood that none of these patents, however, in any way teach or suggest the present invention.

The patent to Humbarger, et al, (U.S. Pat. No. 2,518,894) shows an automatic changeover valve mechanism which uses a combination of two regulators for controlling gas flow from two separate pressure vessels. This valve is of the double diaphragm type and includes a pivoted valve member for each diaphragm. An arm extends outward from a pivoted valve lever which is inserted into an eyelet which is attached to the diaphragm. Each diaphragm is adjustably spring biased to control the amount of pressure which is provided in the outlet from the respective valve. The diaphragms are arranged to release excess gas pressure which may be present in the cavity which is allowed to bypass around or through the diaphragm to be vented from the housing.

The patent to Perkins (U.S. Pat. No. 1,079,904) also shows a spring-loaded diaphragm type regulating valve which utilizes a lever arm which extends through an eyelet provided on the diaphragm. The valve stem in this device allows the pressurized gas to assist in the sealing of the valve and the lever works on an eccentric fulcrum principle.

A patent to Smith (U.S. Pat. No. 3,368,928) shows another diaphragm regulating valve arrangement which is similar to the first two patents. In the Smith device the fulcrum for the lever is provided inwardly from the end of the lever with the shortest portion provided for actuation against the valve seat. These three patents merely show various leverage arrangements for the valve actuation structure.

The patent to Grant (U.S. Pat. No. 2,524,052) is an arrangement for coupling a pressurized gas storage cylinder valve so that the valve is automatically opened when coupled. The Grant device incorporates a threaded coupling retainer in which the interior portion of the coupling automatically forces open the bottle valve poppet when inserted.

The coupling arrangement which is described by Frantz, et al, (U.S. Pat. No. 2,809,658) utilizes a quick-disconnect coupling in which metallic balls are engaged in a groove on the periphery of the probe to hold the probe and valve in secured position. This probe automatically opens the valve to permit passage of the pressurized gas.

The patent which issued to Rogers (U.S. Pat. No. 1,427,854) shows a needle control valve for attachment to a shutoff valve provided on a pressurized gas storage container. The needle valve is held in position on the container valve by means of a rigid yoke having an adjustable retaining screw for tightening and holding the valve in properly aligned position. The opening of the main valve allows the needle valve to control the gas flow to the outlet.

SUMMARY OF THE INVENTION

The present invention provides a novel regulator-valve combination which can be quickly coupled to form a rigid, leak proof, gas pressurization system. Although throughout the description provided herein, reference is made to a beverage dispensing system, it is to be understood that this invention can be utilized in any type of gas pressurization system which can be adapted for use with compressed gas storage cylinders. In addition, even though reference may be made to the use of carbon dioxide gas, the invention can be used with any gas desired.

In a beverage dispensing system it is mandatory that a completely foolproof and safe arrangement be provided. This is especially true in a home dispenser system wherein the average person is required to operate and maintain the system which includes the changing of the pressurized gas storage cylinders. Thus, a simple and completely foolproof system is required to eliminate danger to the individual operating the system regardless of his knowledge or background. Since there is considerable potential energy stored in a pressurized gas system, extreme care must be provided in the design of the components to provide the maximum safeguards for use of the regulator and valve assembly.

The carbon dioxide pressurization system which is described herein for use with a beverage dispenser provides the pressurization and motive force for transferring the fluid beverage syrups or concentrates from their containers and through the dispenser nozzle as desired, as well as carbonating the water mixed with the syrup. The pressurization gas which is stored in a pressure cylinder usually has a gauge pressure within a range of 800–3000 psi depending upon the gas used. The actual working pressure within the syrup storage bottles and carbonator is much lower and usually within the range of 30–100 psi. This lower pressure in the operating system is desirable from a safety standpoint and for quality control of the beverage produced. It must be remembered that if the beverage is to be used in the home environment, nontechnical individuals are required to operate the system and to maintain and replenish the syrup and pressurized gas cylinders. For this reason, the lowest possible operating pressure is desirable in this type of system. The present regulating and shutoff valves provided in the present invention are ideal for this use but can be used in any other pressurization system where exact pressure control and rapid pressurized gas bottle replacement convenience is desired.

This invention is primarily directed to a pressure regulator and a quick-coupling apparatus provided for joining a regulator and cylinder valve for operation and mounting. Most beverage dispensing systems are mounted within a bar or under a counter wherein the bottles containing the syrup, carbonator and pressurized gas cylinder are stored and concealed from view. The regulator of the present invention is arranged to the rigidly or semi-rigidly mounted to the cabinet or bar at a sufficient elevation above the base to allow clearance for the intended pressurized gas storage cylinder. The regulator can be mounted on a mounting plate or bracket which in turn can be attached or mounted to the cabinet. The bracket can have quick release fasteners which allow the regulator to be removed from the bracket, if desired. Usually, a flexible hose is connected from the outlet of a high pressure regulator to the inlet connection of a secondary, lower pressure regulator for pressurizing the syrup containers.

In order to pressurize and maintain the pressure on the system, the compressed gas storage cylinder valve is slidably coupled to the regulator and the cylinder is held upright on the cabinet base. A pivotable retaining yoke having an adjustable retaining screw is positioned over the valve and the retaining screw is turned inwardly to contact the cylinder valve and push the regulator boss into the valve to automatically open a biased shutoff poppet contained within. A peripheral seal is provided around the boss of the regulator to automatically seal the high pressure gas connection between the valve and regulator. With the apparatus provided in the present invention, a storage cylinder can be quickly attached to the system in a safe operating manner. The pressurized gas is introduced automatically to the pressure regulator upon connection of the cylinder without the necessity of manually opening or closing any valve.

The valve provided on the high pressure gas storage cylinder includes a safety burst disc mounted in the body of the valve to prevent over-pressurization of the cylinder which can occur during the filling operation or if heat is accidentally applied to the cylinder which could greatly increase the pressure of the gas contained therein. In the present arrangement, a vented safety plug is threadly inserted into the body of the valve with the burst disc designed for separation at a pressure which is the same as the maximum safe operating pressure for the cylinder.

The cylinder valve contains a slidable poppet which is biased so that the poppet and its associated seal is held in a closed position against a valve seat. This design is provided so that the pressurized gas within the cylinder will assist in applying a force against the poppet to hold the poppet in the closed position. The application of a counter force on the poppet will cause the poppet to move away from the seat, allowing the gas to exit through the outlet of the valve. This outlet is provided in the form of a passageway which is designed to fit a boss on the associated pressure regulator.

The pressure regulator which is used in the present invention is a biased diaphragm-type regulator wherein the spring biasing force can be adjusted by means of a threaded cap. A center eyelet is provided through the diaphragm and is arranged so that the diaphragm can slidably move with respect to the eyelet so that any excess pressure which might exist within the cavity of the regulator can be vented. A pivotally mounted valve having an outwardly extending arm is arranged within the regulator cavity. The valve can pivot toward or away from a valve seat to variably control or stop the flow of gas through a passageway extending inwardly from the inlet boss. The arm of the lever is positioned within the eyelet so that movement of the diaphragm will control the valve movement to control the gas flow and thus, downstream pressure. An outlet fitting is provided in a port in the regulator cavity for the attachment of a hose or tube for pressurization of the dispenser containers.

With the mounting arrangement provided for the storage cylinder in the present invention the pivotable retaining yoke is of major importance in that it permits the sideways attachment of the gas cylinder in a confined space. The arrangement also provides a rigid and safe method for mounting the storage cylinder to minimize the danger to the operator.

As an additional feature of the present invention, a pressure fill adapter is provided for easy and quick refilling of the storage cylinders with compressed gas. The adapter includes a pivotable yoke which has a retaining screw and a valve connecting boss provided at the opposite base end. A flexible fill hose is connected to the boss through a passageway provided in the base end. The fill boss and yoke is identical to that provided on the system pressure regulator and includes an O-ring and groove provided on the outer surface for sealing against the internal bore provided in the cylinder valve. In use, the boss of the adapter is positioned in the opening of the valve and the pivotable yoke is placed in retaining position. The threaded retaining screw is turned inwardly so that the tip is positioned against the valve causing the fill boss to be inserted causing the valve poppet to be opened to allow pressurized gas to flow into the storage cylinder.

The high pressure gas in the fill boss can open the poppet by itself without the fill boss mechanically contacting and opening the poppet. This occurs when the force from the gas pressure exceeds the spring biasing force and causes the poppet to back away from the seat and open. This arrangement may be desirable to allow the cylinder valve to automatically close even without removal of the fill adapter when gas flow stops during the fill process.

The internal openings within the cylinder valve of the present invention are intentionally oversized to permit increased flow of gas and liquid during fill and pressurization use. This allows for rapid transfer of the gas and filling of the cylinders.

It is emphasized that the explanation provided herein and the apparatus which is described is not intended to be limited to use only with carbon dioxide gas but any suitable gas desired for the intended purpose. This invention can be used with any pressurized system in which it is desired to provide a quick-disconnect installation of gas storage cylinders to a gas pressure regulating device in a safe, nonhazardous manner.

DETAILED DESCRIPTION OF THE DRAWINGS

Other features of this invention will appear in the following description and claims, reference being made to the accompanying drawings forming a part of this specification wherein like reference characters designate corresponding parts in the several views.

DETAILED DESCRIPTION

Figure 1:
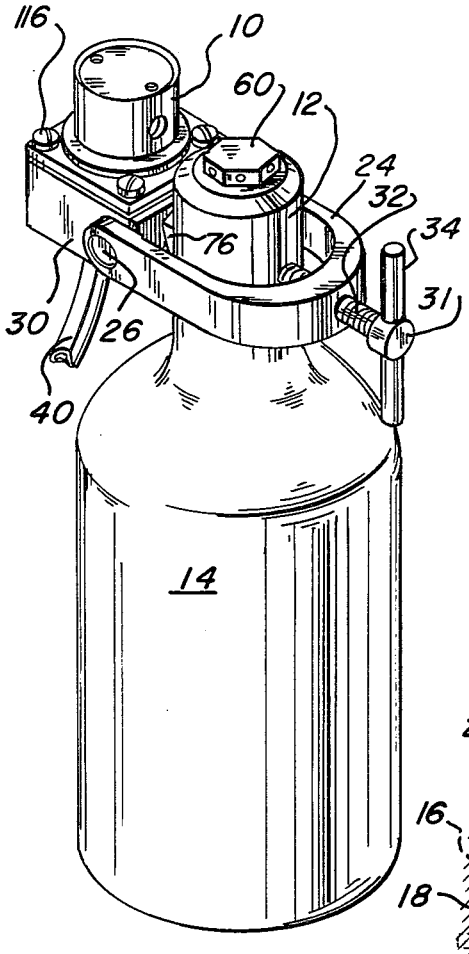
FIG. 1 is a perspective view showing the pressure regulator and the pressurized gas storage cylinder valve of the present invention in the coupled operational position.
Figure 2:
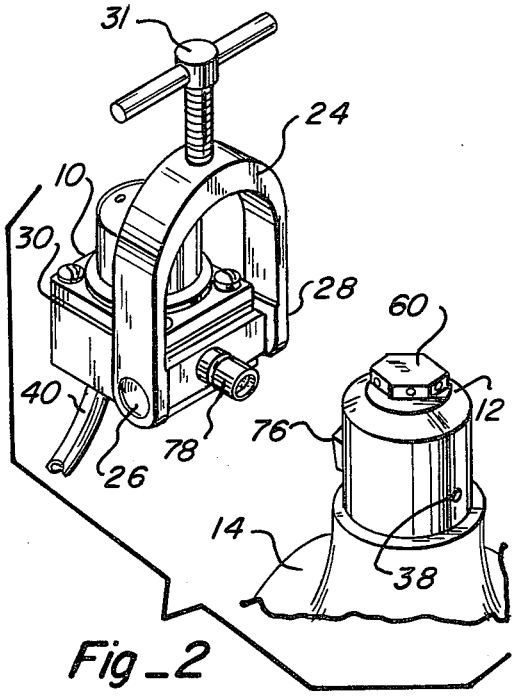
FIG. 2 is a perspective view showing the storage cylinder valve and regulator separated with the yoke of the regulator pivoted upward to facilitate removal of the valve and cylinder.
Figure 3:
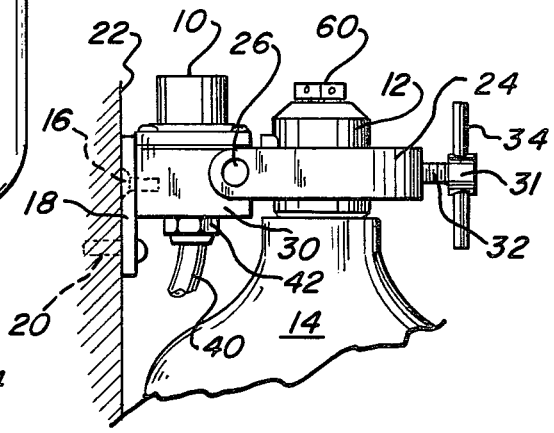
FIG. 3 is a side elevation view showing the gas pressure regulator mounted in an elevated position on a vertical surface and the suspension of the gas storage cylinder by the cylinder valve coupled to the regulator.
Figure 4:
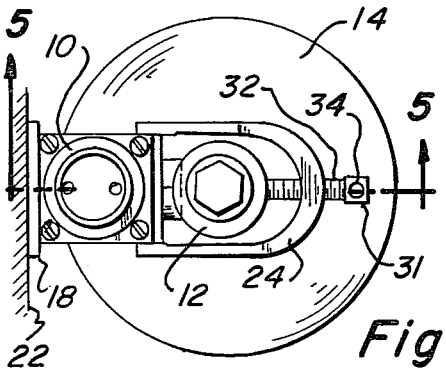
FIG. 4 is a top plan view showing the mounted pressure regulator and the coupled gas storage cylinder valve in their respective positions.

Turning now more specifically to the drawings, FIGS. 1, 3 and 4 show the pressure regulator 10 coupled with a gas storage cylinder valve 12 which is threadly connected to a gas storage cylinder 14. Although it is not mandatory, it is desirable that the pressure regulator 10 is mounted to a suitable bracket or mounting plate 18 which in turn is securely fastened by fasteners 20 to a vertical wall or side of a cabinet 22. The mounting bracket or plate 18 is attached at a height which will permit the gas cylinder to be freely connected above the horizontal surface. It is possible to make the fastener 16 which holds the regulator 10 to the bracket 18 of the quick release type (not shown) so that the regulator can be readily dismounted, if desired. It is necessary to dimensionally size the regulator 10 so that when the gas cylinder is operationally installed, the side of the gas cylinder will have clearance between the vertical wall upon which the regulator is mounted.

FIG. 1 illustrates the components of the present invention as if they are standing in free air. It is intended, however, that the apparatus is to be mounted similar to the arrangement shown in FIGS. 3 and 4 by means of the mounting plate 18. The reason for adapting the regulator to be mounted in this fashion is in the interest of safety when dealing with high pressure gas storage cylinders. The present invention provides an extremely easy and quick coupling and support arrangement for the gas storage cylinder 14 so that it is relatively protected and cannot be overturned whereby the valve 12 or cylinder 14 could be damaged or fractured. Any time a valve on a high pressure gas cylinder is damaged or broken it is highly possible that the cylinder can explode or thrash violently causing damage and destruction. Although the drawings illustrated herein depicts the storage cylinder or bottle 14 as a small vessel it is possible that a considerably larger storage cylinder could be utilized which can necessitate the strengthening and possible enlarging of the pressure regulator body structure and retaining yoke in order to adequately support the additional weight of the cylinder.

If the regulator itself is not mounted to a rigid vertical structure with sufficient height to allow the gas cylinder to be suspended or supported, then it is possible to utilize the present invention by merely mounting the pressure regulator onto the cylinder valve with the cylinder resting on a suitable horizontal surface. In such case, for safety reasons it is preferable to restrain the cylinder to prevent movement or tipping, e.g. by a chain, clamp or strap.

The regulator 10, in order to facilitate coupling and rigid support of cylinder 14 and valve 12, provides a U-shaped retaining yoke 24 which is pivotably mounted by pins 26 and 28 at its free ends to the body 30 of the regulator 10. A retaining screw 31 having a threaded body 32 and bar type handle 34 is threadly mounted in the medial portion of the yoke 24. The rounded tip end 36 of the threaded body 32 is sized to fit into detent 38 provided on the outer surface of the cylinder valve 12. An outlet pressure tube 40 is suitably connected by fitting 42 to the outlet port provided in the body 30 of the regulator 10.

Figure 5:
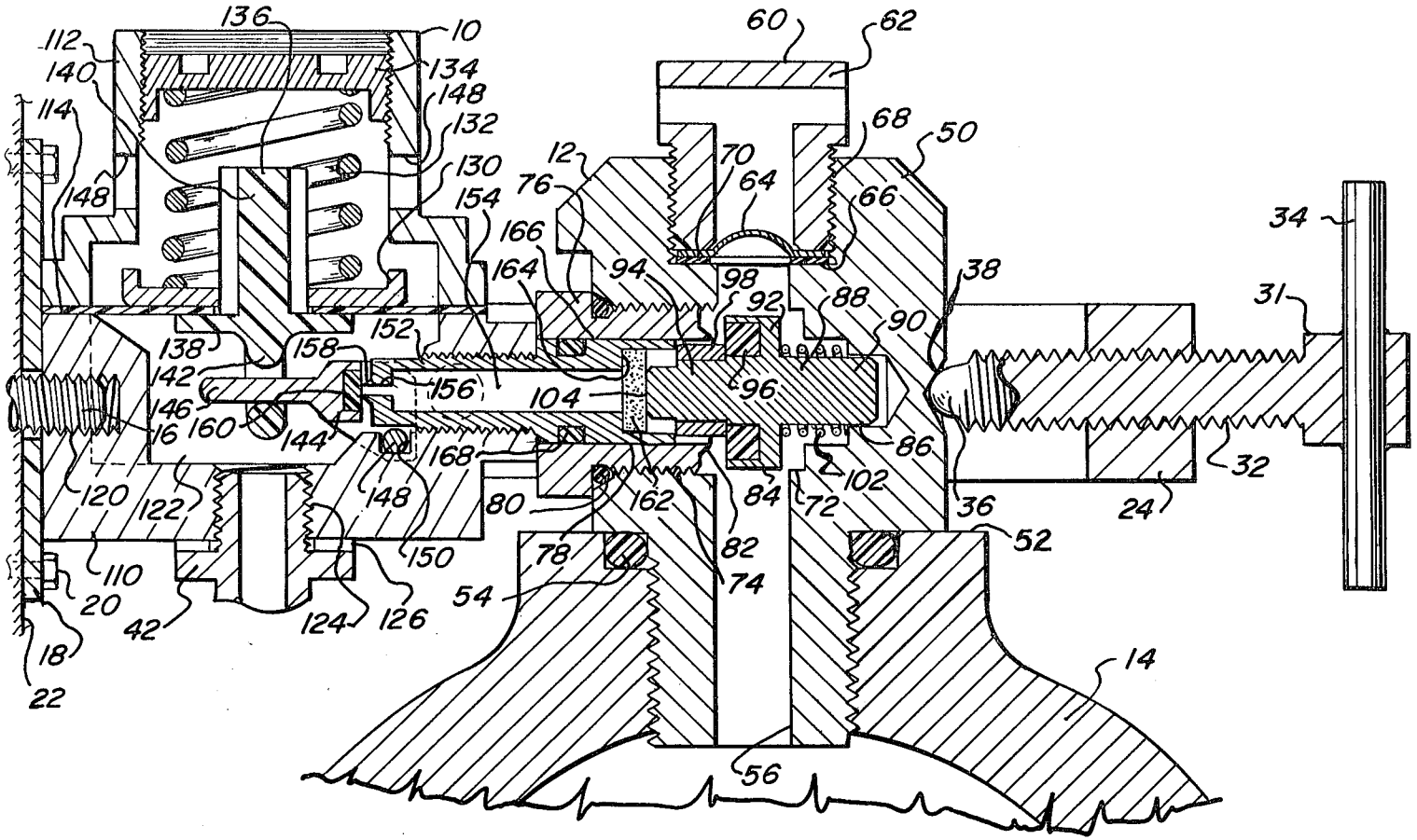
FIG. 5 is an enlarged cross-sectional view of the assembled components taken along the lines 5—5 of FIG. 4.

The internal structure of the gas storage cylinder valve and pressure regulator and the novel way in which they couple is shown in FIG. 5. As can be seen in this view, the regulator and valve assembly are shown in the operating position whereby the stored gas can pass to the regulator which is shown in the closed position.

The valve 12 is threadly connected to the storage cylinder 14 with the body 50 of the valve bottomed out against the upper surface 52 of the cylinder neck. An O-ring seal 54 is provided for prevention of gas leakage through the threaded joint. A central bore 56 extends through the body 50 of the valve 12. A burst disc assembly 60 having a vented plug 62, rupture disc 64 and seal 66 are provided to safely vent the pressurized gas if an excessively high pressure within the cylinder is present. This is a required safety device and is very desirable to prevent over pressurization of the cylinder and possible explosion.

A transverse passageway 72 having a threaded outer portion 74 is provided in the central portion of the valve body 50 and communicates with the bore 56. A retaining fitting 76 having a smooth internal bore 78 is threadly inserted into the body bore 74. An O-ring 80 is provided to prevent leakage. The inner edge of the fitting 76 is finished in a sharp lip 82 which forms a seat for the poppet check-valve 84. A blind hole 86 is provided at the end of the bore 72 to provide a guide for the poppet 84. The poppet 84 has an elongated body 88 having a cylindrical end 90, outwardly extending flange portion 92 and probe end portion 94. The outwardly extending flange 92 includes an undercut portion in which a seal 96 is embedded. The seal is positioned to contact the seat 82 when the poppet is moved to the left as viewed in FIG. 5. A guide sleeve 98 which can be perforated or star shaped and having an outer diameter to loosely fit the bore 78 is pressed over the probe end 94. This sleeve 98 keeps the poppet in alignment and yet alows passage of the gas through a relatively large area around the poppet to minimize restriction and pressure drop. A helical spring 102 or other biasing device is used to urge the poppet 84 into the closed position to retain a gas tight seal. A chamfered edge is provided on the probe end 94. This end of the poppet engages the regulator bushing which causes the poppet 84 to move to the right against the spring 102 so that the seal 96 is moved away from the seat 82 to allow passage of the compressed gas into the regulator.

Figures 6, 7, 8:
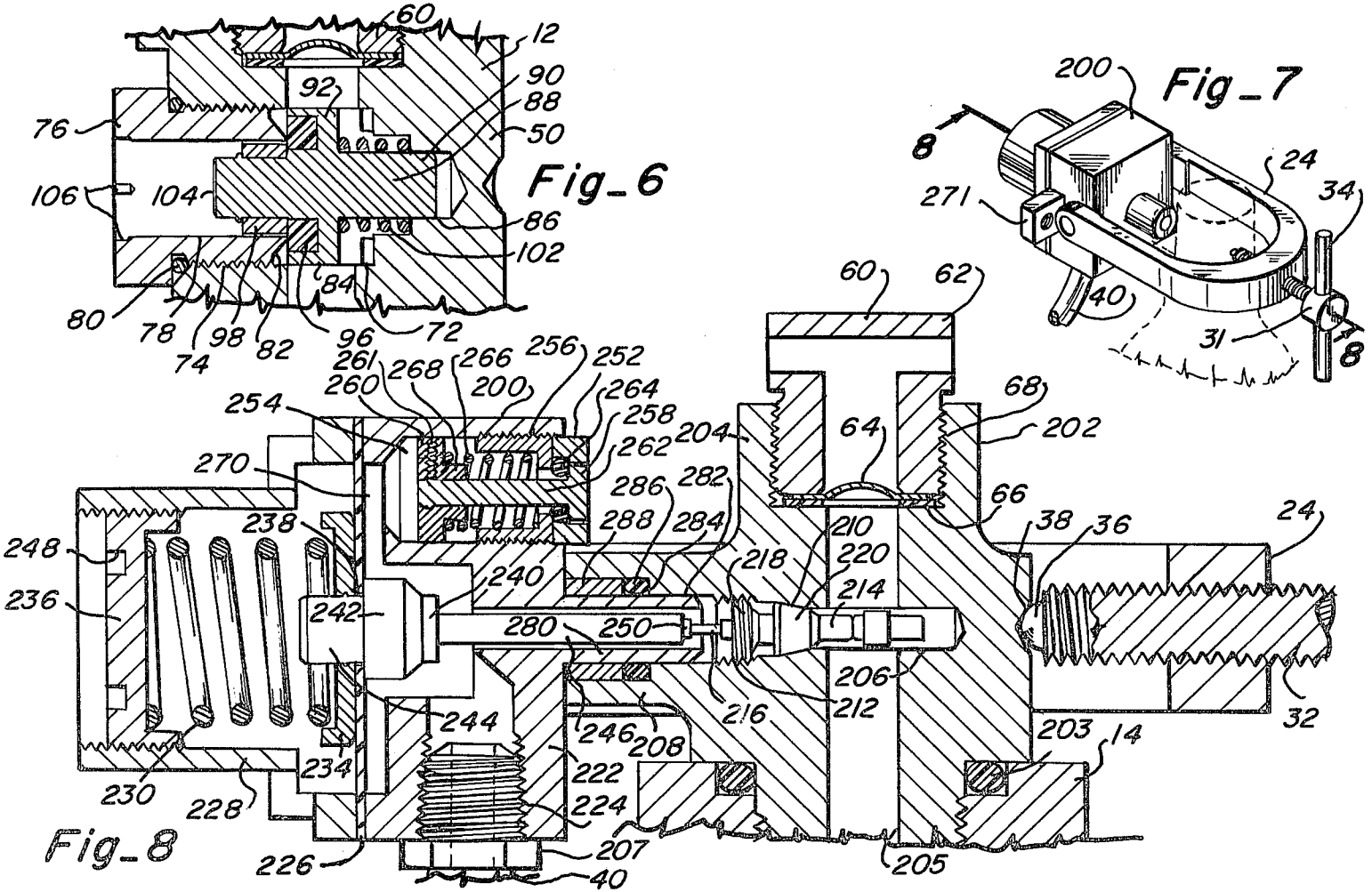
FIG. 6 is a partial sectional view showing the shutoff poppet provided in the gas cylinder valve.
FIG. 7 is a perspective view of a pressure regulator and retaining yoke of another embodiment wherein the diaphragm of the regulator directly actuates the cylinder shutoff valve.
FIG. 8 is an enlarged cross-sectional view showing the coupled regulator and valve showing the diaphragm actuation rod in contact with the shutoff valve poppet.
Figure 9:
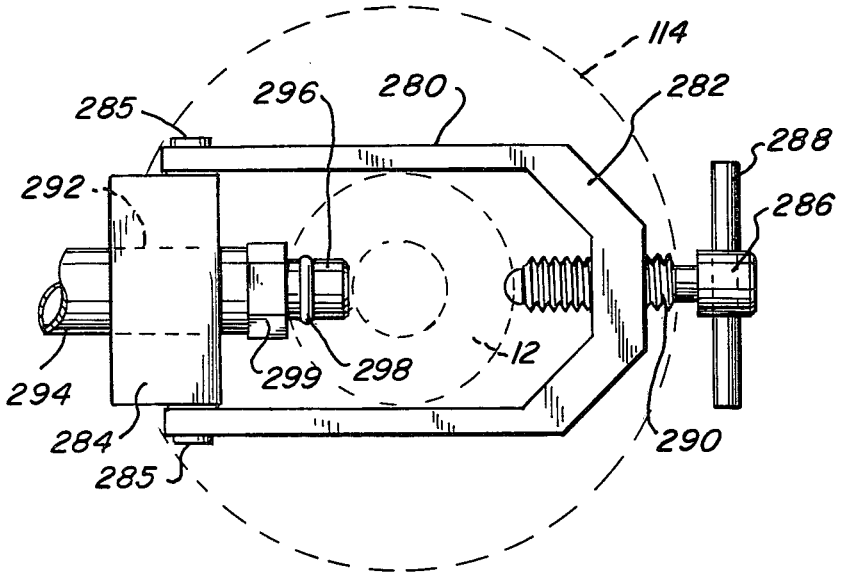
FIG. 9 is a top plan view showing a fill adapter according to the present invention which is used for filling the gas storage cylinders through the shutoff valve.

FIG. 6 is an enlarged view of the internal structure of the disengaged compressed gas cylinder valve 12 which shows the poppet 90 in the closed position. It can be seen that there is a large projected area on the backside of the poppet 84 opposite the bore 78 against which the gas pressure is exerted which causes an additional force to be applied to the poppet assisting the biasing spring 102 to retain the poppet in the sealed position. This arrangement assures a leak tight system to retain the pressure of the gas within the cylinder during extensive storage. In this way, original gas pressure is maintained for use in pressurizing the dispensing system when the cylinder is installed. Short and shallow longitudinal slots 106 are provided in the outer edge of the bore 78 to allow gas pressure trapped within the bore to be safely dissipated upon disengagement of the cylinder valve from the pressure regulator boss.

The pressure regulator 10 is a separate but integral part of the overall beverage dispensing system. The regulator 10 has a body 110 and a spring housing 112. A continuous diaphragm 114 of flexible material is sandwiched between the body and housing and provides a gasket seal between the mating surfaces of these parts. The housing 112 is mounted on the regulator body 110 by means of suitable fasteners such as screws 116.

An internal cavity 122 is provided within the body 110 with a threaded outlet 124 communicating therewith. The outlet fitting 42 and seal 126 is connected to the body 110 and the flexible hose or tube 40 is connected between the fitting and the beverage dispensing system. The upper portion of the cavity 122 is closed by the diaphragm 114.

A diaphragm backup plate 130, helical biasing spring 132 and spring adjustment cap 134 are provided within the housing 112. The spring adjustment cap 134 is threadly mounted in the housing 112 and incorporates a pair of blind holes which are provided for a spanner wrench. The rotation of this cap either in or out adjusts the compression force of the spring against the diaphragm backup plate 130 to adjust the set point of the gas pressure at the outlet. A diaphragm fitting 136 has a flange 138 positioned on the pressure side of the diaphragm 114 and a shank 140 which extends through an aperture provided in the center of the diaphragm 114 and the backup plate 130. In this way, the diaphragm fitting 136 according to the present invention is designed to provide a safety release of any excess pressure which might be present within the cavity 122. The size of the diaphragm and backup plate aperture is maintained at a close tolerance to provide a close fit with the outside diameter of the shank 140. Longitudinal grooves are provided along the outside surface of the shank 140 to permit passage of gas.

This safety feature is provided by the ability of the diaphragm to bypass excess pressure over and above the set point of the regulator. Excess pressure in the cavity 120 causes the continued upward movement of the diaphragm which causes the backup plate 130 and diaphragm 114 to move away from the flange 138. This creates a gap which allows the excess gas pressure to bypass through the center aperture and into the housing 112. This excess gas is easily vented through the openings 148 which are provided on opposite sides of the housing 112. In this way, excessively high pressure which might exist at the outlet is relieved through the diaphragm fitting which prevents excessively high pressure from existing in the beverage dispensing system.

The pressure regulating function is provided by the valve lever 144 which is pivotably retained by a pin 148 which is secured in a transverse groove 150. The moveable valve lever 144 has a pir of bifurcated legs which are secured by the pin and arranged to straddle an elongated valve bushing 152. The valve bushing 152 has an enlarged inner passageway 154 which has a small drilled passageway 156 provided at one end. A sharp outer lip 158 provides a valve seat at the exit to the passageway 156. A resilient seal material 160 is provided in the end portion of the valve lever 144 whereby a gas tight seal can be provided at the seat 158 when the lever arm 146 is raised upwardly by the eyelet 142 as the diaphragm moves upwardly against the biasing spring 132 in response to an increase in gas pressure in the cavity 122.

The inner portion of the valve boss or bushing 152 includes a threaded section which mates with a threaded passageway provided in the regulator body 110. The opposite end of the passageway 154 incorporates a rigid filter disc 162 which can be of a porous material such as sintered bronze and which is pressed fit into a deep recess 164 provided in the end of the bushing 152. A smooth outer surface 166 is provided on the bushing 152 and is sized to closely fit the inner passageway 78 provided in the valve fitting 76. An O-ring seal 168 is provided in a circumferential groove on the outer surface of the bushing to provide a gas tight seal when the cylinder valve is mated with the pressure regulator bushing.

The operation of the pressurization system as provided in the present invention is novel from the standpoint that the installation and coupling of the gas storage cylinder can be performed in an extremely easy and safe manner in a confined area. This is especially true under office cabinets and bars and in home installations where a relatively small dispensing system is required. In operation the gas cylinder 14 and its installed cylinder check-valve 12 is positioned so that the internal bore or passageway 78 of the valve fitting 76 is positioned and aligned with the end of the regulator bushing 152. After proper alignment, the valve is moved laterally to engage the bushing with the passageway 78 in a sliding manner. Once the O-ring 178 has been moved into the passageway 78 the yoke 24 which has been pivoted upwardly in a raised position is then lowered to a horizontal or retaining position. The retaining screw 31 is then turned inwardly with the end 36 engaging the detent 38 in the backside of the valve housing 50. Continued turning of the screw handle 34 causes the screw to extend forcing the regulator bushing 152 into contact with the poppet sleeve 98. Continued turning of the retaining screw 31 causes the valve body 50 to continue moving to the left, as seen in FIG. 5, causing the poppet seal 96 to move away from the seat 82 allowing passage of the stored gas to flow through the exposed portion of the sintered filter material 162 so as to pass through the bushing cavity 154 to the valve seat 158.

With reduced pressure in the cavity 122, the diaphragm 114 is in an extended or lowered position which allows the valve lever 144 to pivot in a counterclockwise or downward direction which allows the seat 158 to be open. As pressure builds in the outlet hose 40 and cavity 122 the diaphragm 114 responds by moving in an upward direction against the biasing force of the spring 132. This upward movement causes the fitting 136 to follow the movement of the diaphragm causing the valve lever 144 to move clockwise or pivot upward so as to reduce and eventually close the opening in the valve seat 158 as the pressure in the outlet hose 40 approaches and reaches the desired pressure. If the pressure in the outlet is subsequently reduced this allows the diaphragm again to move in the downward direction causing the valve to open again to increase the pressure to continually maintain it at the desired set pressure.

With the retaining screw 31 extended, the valve and regulator are firmly engaged as a rigidly coupled assembly wherein the gas pressure is automatically introduced into the regulator and the cylinder and cylinder valve are rigidly and safely supported in the operational position.

In order to quickly change cylinders when the gas in the existing cylinder is depleted, the process is reversed with the retaining screw backed out allowing the yoke to be pivoted into the upward position so that the valve can be further moved outwardly to disengage with the regulator bushing or boss. The yoke 24 can remain in the upright position leaning against the cabinet wall until pivoted again into the retaining position.

It is possible and condidered part of this invention to split the inlet to the regulator into any number of passageways and provide a bushing or boss for each to receive a corresponding number of gas storage cylinders at the same time. A one-way check-valve which would only allow gas to flow from the respective cylinder and valve into the regulator would be provided in each passageway. The size of the regulator body and the position of the bosses would be designed to provide the necessary clearance between cylinders. In this way, the gas storage volume can be increased and gas pressure in the system can be maintained while the cylinders are being replaced.

In another embodiment of the combination regulator and valve, FIGS. 7 and 8 shows a regulator body 200 coupled with a cylinder valve 202 but only one actuating valve is provided for the two devices.

The compressed gas cylinder valve 202 includes the body housing 204 which is threadly connected to the gas cylinder 14 in the conventional manner. An O-ring seal 203 is provided in a circumferential groove at the opening of the cylinder 14 to seal the connection against gas pressure loss. As previously described, a central passageway 205 extends centrally through the body 204 and joins a threaded passage 68 which contains the burst disc plug 60 which includes the vented fitting 62, burst disc 64 and seal 66.

In a manner similar to that which was described in the previous embodiment a lateral passageway 206 is provided transverse to the central passage 205. A boss 208 extends outwardly from the body 204 to form a coupling receptacle for the pressure regulator 200. The lateral bore 206 includes a smooth beveled section 210 and an internally threaded portion 212. A spring loaded check-valve unit 214 is threadly inserted into the lateral bore 206 and forms a check-valve to retain the stored gas within the cylinder. The check-valve unit 214 can be of the tire valve type which has a center plunger 216, a threaded body portion 218 and the resilient seal 220 which seals against the beveled surface 210. As is well-known, applying force to the end of the plunger 216 will cause the valve seat to open causing the release of the gas pressure within the cylinder. Thus, the cylinder storage valve 202 when properly mounted on the cylinder 14 provides a single spring-loaded check-valve which seals the cylinder and retains the gas pressure internally until such time that it is intended to be used.

In conjunction with the cylinder valve is the pressure regulator 200 which can be suitably mounted to the vertical wall, as previously described. In this arrangement, however, the regulator housing 222 includes the threaded outlet port 224 in which the fitting 207 and outlet hose 40 are connected. A spring housing 228 is fastened to the body 222 by suitable fasteners such as screws (not shown) with the diaphragm 226 mounted between flanges of the two elements. The diaphragm has a center aperture 238 which receives the diaphragm actuator 240 which has an enlarged body portion 242, stud 244, and actuator plunger or rod 246. The stud 244 extends through the diaphragm aperture 238 and is secured to the diaphragm support or backup plate 234. A compression spring 230 is positioned between the diaphragm backup plate 234 and the adjustable compression nut 236. The compression nut 236 is suitably threaded into the outer end of the spring housing 228 and is provided with recessed bores 248 which allow the nut 236 to be turned in or out by a spanner wrench or key to vary the spring biasing force and thus, the outlet gas pressure from the regulator valve. With the actuator stud 244 staked or swaged to the backup cap 234 there is a permanent and rigid leak proof seal between the actuator 240 and the diaphragm 226 to prevent any leakage or bypassing of gas past the diaphragm. The actuator push rod or plunger 246 is designed to have a length whereby the rod 246 is of the proper dimension to contact the end of the plunger 216 in the check-valve 214.

Pressure relief within the regulator cavity 270 is provided in this embodiment by means of a separate pressure relief valve 252. The pressure relief valve is mounted in a separate passageway 254 which is provided in one portion of the regulator housing 222. Passageway 254 is arranged to threadly receive hollow sleeve 256. An internal relief poppet having a flange 258 extends from the shaft 262. The end of the shaft 262 is secured to a second piston 260 by a set screw 261. The second piston 260 has an outside diameter which slidably fits within the passage 254. A helical biasing spring 266 is internally positioned between a shoulder provided on the sleeve 256 and the backside of the piston 260. A shoulder 268 is provided on the piston 260 to act as a spring guide to retain the spring convolutes in alignment. An O-ring seal 264 is provided along a groove provided on the inside surface of the flange 258 which seals against the end of the sleeve 256. One or more passageways can be drilled through the body of the piston 260 to allow the gas pressure to be exerted on the inside face of the flange 258. With the proper spring bias force provided within the valve, the valve can be arranged to relieve excessively high gas pressure which may exist within the regulator outlet cavity 270. The flange 258 will be urged to move to the right against the spring compression force allowing gas to escape past the O-ring seal 264 and be vented to the atmosphere. There is also a relief opening provided in this flange behind the O-ring seal 264 to vent any gas which may be trapped in the O-ring groove.

Mounting flanges 271 can be provided on each side of the regulator body 222 so that suitable mounting fasteners such as woodscrews can be inserted through the flanges 271 to suitably mount the regulator on a vertical surface of a cabinet interior similar to the arrangement previously described. In this mounting arrangement, the end of the housing 228 is held rigidly against the surface to stabilize the overall regulator. An exposed cylindrical connecting bushing or boss 280 is provided as an extension of the regulator housing 222 and houses the actuator plunger rod 246. The outer end 282 of the lateral passageway 206 includes a smooth inner surface and incorporates a shoulder 284 which provides a backup for a sealing O-ring 286 which is held in position by a suitable pressed fit sleeve 288.

To install and operate the components according to the present embodiment, the cylinder valve 202 is positioned so that the outer end 282 of the lateral passage 206 and the inside diameter of the sleeve 288 is positioned in alignment with the regulator boss 280. By sliding the valve 202 which is connected to the storage cylinder 14 toward the left as viewed in FIG. 8, the boss 280 is pushed into the lateral passageway 282 causing its outer surface to seal against the O-ring 286. At this point, the yoke 24 is lowered to the retaining position as shown in FIG. 7 and the retaining screw 31 is turned to engage the detent 38 provided in the back surface of the valve housing 204. The movement of the screw 31 pushes the valve 202 over the regulator boss 280 causing the plunger rod 246 to come into contact with the check-valve plunger 216. With the valve 202 touching the side of the regulator housing 222, the components are intended to be in proper longitudinal position to variably control the flow of gas through the valve 214. As pressure is increased within the cavity 270 the diaphragm 226 is forced to move against the biasing spring 230 causing the actuator rod 246 to move toward the left, as viewed in FIG. 8, and thus, allow the valve plunger 216 to return to its closed or sealing position. The valve 214 is intended to be fully closed when the pressure within the outlet and chamber 270 reaches its predetermined set pressure. In this way, a single valve assembly is utilized both for the shutoff function of storing the pressurized gas within the cylinder and the control valve function through actuation by the pressure regulator diaphragm.

Figure 10:
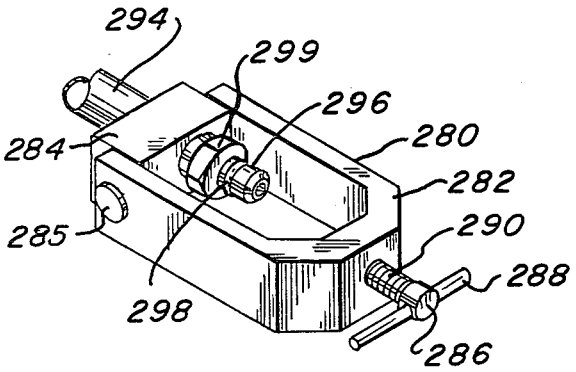
FIG. 10 is a perspective view showing the cylinder fill adapter.

To compliment the features which are provided by the present invention, a fill adapter is included as one of the components of this invention to allow quick and easy refilling of the compressed gas storage cylinders. FIG. 10 shows the fill adapter 280 in a perspective view with a pivotable yoke 282 and a base 284. A threaded retaining screw 286 including a handle 288 and shank 290 is positioned through a threaded passage in the yoke 282 opposite the base 284. The threaded ahank has 290 a rounded tip and the longitudinal axis of the retaining screw 286 is axially aligned with the base 284.

The central portion of the pivotable yoke 282 has an open area which has a width which is large enough to receive the cylinder valve which has been described herein. A bore 292 is centrally positioned through the base 284 and is arranged to receive the pressurized gas tube 294. The tube 294 can be mounted in the yoke base 284 by being threadly connected in the passage 292 or it can have retaining nuts on each end which are tightened to rigidly hold the tube in proper longitudinal position. A fitting 299 is securely attached to the end of the tube 294 and includes an elongated probe 296 having an external O-ring seal 298. The end of the probe 296 is chamfered to permit easy insertion into the cylinder valve. The probe 296 can be used with either of the cylinder valves which have been described herein with only minor modification. The position of the fitting 299 is longitudinally adjusted so as to be in the same location as the probe on the regulator for which the cylinder valve is designed.

With the retaining screw backed out and the yoke 282 raised, the probe 296 is aligned with the valve opening. By atarting the probe 296 into the valve passageway, alignment of the valve and fill adapter is provided. The yoke is then pivoted downward into a retaining position and the retaining screw 286 is turned inward to move the valve onto the fitting 299 until it is bottomed out and the fill adapter is securely retained on the cylinder valve. It is not necessary for the probe 296 to mechanically open the cylinder check-valve poppet since gas pressure alone can be used to open the check-valve during the fill operation. Once the connection has been securely made, pressurized gas which can be in the liquid state is introduced into the cylinder through the tube 294 until the proper quantity is stored within the cylinder. At this time, the retaining screw 286 is backed out allowing the cylinder valve to move away from the fitting 299 which allows the internal check-valve within the cylinder valve to move to its closed position and thus, seal the opening. In his way, a safe and quick arrangement is provided for filling the gas storage cylinders either by the user or by a supplier.

The materials with which the gas cylinder valve and regulator are fabricated are not critical. The materials utilized in the fabrication of these parts can be any suitable metal or high strength synthetic resin or plastic which will have the strength which is required for safe operation of the components. Aluminum and brass because they are easy to work and machine, have been found quite suitable for use in the fabrication of the parts described. The seals can be fabricated from any resilient elastomeric material which is suitable for this purpose. The most important consideration in the fabrication and manufacture of the parts provided for the present invention is the aspect of safety with freedom of corrosion from moisture or other minor chemical reaction. The components, out of necessity, must be capable of being cleaned repeatedly to prevent contamination of the beverage dispensing system.

Although a gas pressurization system has been shown and described in detail, it is obvious that this invention is not to be considered as being limited to the exact form disclosed, and that changes in the detail and construction may be made therein within the scope of the invention, without departing from the spirit thereof.

What is claimed is:

1. A regulated gas pressurization system for providing a continuous supply of gas at a predetermined pressure from a source of high pressure gas stored in a pressurized cylinder, said system comprising:

(a) a fitting means arranged to be attached to a valve means which is mounted on a storage cylinder providing a gas tight closure for said cylinder, (b) a pressure regulator means having an outlet port, and (c) a coupling means which is arranged to quick connect said regulator means and said cylinder fitting means whereby the pressurized gas is allowed to flow from the cylinder through the regulator means and outlet port so as to supply and maintain a predetermined gas pressure, (d) said coupling means including a connecting boss having a passageway therethrough, a pivotable retaining yoke mounted on said regulator means, and a receiving passageway means which is arranged to slidably receive the connecting boss, said yoke having a retaining means and being pivotable from a raised position, said connecting boss contacting said valve means when slidably moved into said receiving passageway means to automatically open said valve means as said valve means is joined to said pressure regulator means using said retaining means and said passageway of said connecting boss conducting the flow of gas from said valve means to said pressure regulator means.

2. A pressurization system as defined in claim 1 wherein said hand operable retaining means is a retaining screw.

3. A pressurization system as defined in claim 1 wherein said valve means includes a slidable spring biased poppet and said connecting boss has sufficient length to contact and slidably open said poppet to allow the high pressure gas to flow into the regulator when said regulator and valve means are connected.

4. A pressurization system as defined in claim 1 wherein said valve means includes a burst disc vent means which is arranged to rupture if the gas pressure within said storage cylinder exceeds a predetermined safe pressure.

5. A pressurization system as defined in claim 1 wherein said regulator means is rigidly mounted at a sufficient height to permit the gas storage cylinder to be supported by the regulator connecting boss when the valve and regulator means are connected together.

6. A pressurization system as defined in claim 5 wherein said regulator means is mounted on a bracket means, and said bracket means includes release fastening means so that said regulator means can be quickly removed from said bracket means when desired.

7. A pressurization system as defined in claim 1 wherein said regulator means includes a biased diaphragm which is arranged to move against an adjustable biasing means in response to the pressure at the outlet port, said diaphragm having an actuator means which moves a control valve in response thereto so as to control the flow of gas and maintain the desired pressure at said outlet port.

8. A pressurization system as defined in claim 7 wherein said control valve is pivotably mounted and arranged to close the passageway through said connecting boss, the control valve movement is controlled by the movement of said diaphragm actuator in response to the gas pressure at said outlet port.

9. A pressurization system as defined in claim 7 wherein said control valve means in said cylinder valve means, and said diaphragm actuator means is in contact with the cylinder valve means when said valve means and regulator are connected together by said coupling means, the opening and closing of the cylinder valve means is controlled by the movement of the biased diaphragm and actuator means.

10. In a beverage dispensing system which includes one or more beverage concentrate containers, a carbonator for producing a carbonated liquid for mixing with said concentrate, a dispensing valve means, a compressed gas storage cylinder and a gas pressurization system for carbonating said liquid and maintaining a constant minimum gas operating pressure within said containers to force the concentrate to flow from the container through the dispensing valve means to produce a desirable beverage, the improvement being a gas pressurization system allowing safe reliable operation and safe and quick replenishment of the gas pressure cylinder when required, said pressurization system including:

(a) a gas pressurization regulator means which can be suitably mounted on a rigid structure, (b) a gas check-valve means arranged to be mounted on a gas storage cylinder, said check-valve means having a slidably poppet which is biased to the closed position to form a leak tight seal for said gas storage cylinder, and (c) quick coupling means for slidably joining the regulator means and check-valve means together, (d) said regulator means having an operating diaphragm means and an actuator means connected to said diaphragm means, said diaphragm means having an adjustable biasing means on one side to counter balance the gas pressure within the regulator means, said actuator means is connected to a control valve means which controls the passage of gas from the cylinder to the containers, said biasing means being adjusted to obtain a predetermined operating gas pressure downstream of said control valve means, and (e) said quick coupling means includes an elongated boss mounted on one means and a receptacle passageway sized to fit said boss mounted in the other means and a retaining means for holding the regulator and check-valve means together in their connected position, said elongated boss contacting said slidable poppet when said boss is slidably moved within said receptacle passageway to automatically open said check-valve means and allow the gas to flow through said regulator means and into the system.

11. An improved gas pressurization system as defined in claim 10 wherein said retaining means is a pivotably mounted yoke having a retaining screw positioned therein, said yoke being mounted on said regulator means and positionable to a raised position to allow the check-valve means to be slidably engaged with the regulator means and lowered to a retaining position whereby the retaining screw contacts said check-valve means and holds the check-valve means in an engaged position with said regulator means whereby said cylinder is rigidly secured in the supported position.

12. An improved gas pressurization system as defined in claim 10 wherein said elongated boss is arranged to contact and slidably open said poppet when said regulator means is connected with said check-valve means which allows the automatic passage of gas from said storage cylinder and through said boss to the regulator means.

13. An improved gas pressurization system as defined in claim 10 wherein said receptacle passageway includes an internal circumferential groove and an O-ring seal contained therein whereby the seal is protected when the regulator and check-valve means are not connected but form a gas tight seal between the means when said elongated boss and receptacle passageway are connected.

14. An improved gas pressurization system as defined in claim 10 wherein the slidable poppet of said check-valve means is positioned against a valve seat in the closed position, said valve seat and said poppet are sized to provide a relatively large, flow area when said poppet is moved to the open position to allow a high rate fluid flow between said cylinder and regulator means when said regulator and check-valve means are connected.

15. An improved gas pressurization system as defined in claim 10 wherein two separate gas valves are provided, one valve is provided within said gas check-valve means and includes said poppet and the other valve is connected to the diaphragm actuation means within said pressure regulator means, each valve in turn separately controls the flow of gas from said gas storage cylinder to the beverage dispensing system.

16. An improved gas pressurization system as defined in claim 10 wherein said control valve means includes the slidable poppet and the diaphragm actuator directly contacts the slidable poppet within said check-valve means so that the poppet follows the movement of said diaphragm to control the gas flow from the cylinder and maintain the predetermined operating pressure within said pressurization system.

17. An improved gas pressurization system as defined in claim 10 wherein said quick coupling means is arranged to hold the cylinder in a rigid supported position to prevent tipping and possible damage to the gas cylinder.

18. A gas pressure regulator and check-valve combination for allowing quick but rigid connection of a high pressure gas source to a lower pressure controlled pressurization system, the combination including:

(a) a gas check-valve means connected to a high pressure source of gas, said check-valve means having a spring biased internal slidable poppet mounted within an elongated receptacle passageway communicating with the outer surface of said valve means, said slidable poppet including a seal for sealing the gas pressure source when the poppet is in the closed position, (b) a regulator means having a hollow inlet boss means and an outlet port, said regulator means having a biased diaphragm mounted therein and an actuator arranged to follow the movement of said diaphragm, (c) said hollow boss means being slidable to interconnect the check-valve and regulator means in a gas tight releasable connection through the receptacle passageway, the diaphragm actuator contacting said slidable poppet when said boss is slidably moved within said receptacle passageway to automatically open said check-valve means, and (d) a pivotable yoke having a retaining screw, said yoke being pivotably mounted on said regulator means whereby said yoke may be moved to a raised position to allow the passageway of the check-valve means to be positionally aligned with the boss means and actuator of the said regulator means whereby the regulator means can be slidably engaged in a short lateral movement and said yoke lowered into a retaining position whereby the retaining screw can be turned inward to contact the check-valve means and hold the valve means in a secure coupled operating position with said regulator means.

19. A regulated gas pressurization system for providing a continuous supply of gas at a predetermined pressure from a source of high pressure gas stored in a pressurized storage cylinder, said system comprising:

(a) a gas pressurization regulator means, (b) a gas check-valve means arranged to be mounted on a gas storage cylinder, said check-valve means having a slidable poppet which is biased to the closed position to form a leak tight seal for the gas storage cylinder, (c) quick coupling means, including a portion rigidly attached to said regulator means and a portion rigidly attached to said check-valve means, for slidably joining the regulator means and check-valve means together, one of said portions comprising an elongated boss mounted on one means and the other portion a receptacle passageway, sized to fit said boss, mounted in the other means, said elongated boss contacting said slidable poppet when said boss is slidably moved within said receptacle passageway to automatically open said check-valve and allow the gas to flow through said regulator means and into the system, and (d) said quick coupling means further including a retaining means for holding said regulator means and said check-valve means together in their connected position.

20. A pressurization system as defined in claim 19 wherein said regulator means includes an operating diaphragm means and an actuator means connected to said diaphragm means, said diaphragm means having an adjustable biasing means on one side to counter balance the gas pressure within the regulator means, said actuator means is connected to a control valve means which controls the passage of gas from the cylinder to the system, said biasing means being adjusted to obtain a predetermined operating gas pressure downstream of said control valve means.

21. A pressurization system as defined in claim 19 wherein said coupling retaining means is mounted on said regulator means.

22. A pressurization system as defined in claim 21 wherein said retaining means is arranged to contact the side of said check-valve means opposite from said regulator means.

23. A pressurization system as defined in claim 21 wherein said retaining means is a pivotably mounted yoke which can be pivoted to an upright position wherein the elongated boss and their receptacle passageway can be easily aligned and engaged to a retaining position wherein said regulator and gas check-valve means are rigidly held in operating position.

* * * * *

UNITED STATES PATENT AND TRADEMARK OFFICE

CERTIFICATE OF CORRECTION

PATENT NO. : 4,363,424

DATED : December 14, 1982

INVENTOR(S) : Holben et al

It is certified that error appears in the above—identified patent and that said Letters Patent is hereby corrected as shown below:

On the Title Page, change

"[73] Assignee: Cadbury Schweppes PCL, London, England"

to read

--[73] Assignee: Cadbury Schweppes, Limited, London, England and C.A. Norgren Co., Littleton, Colorado --.

Signed and Sealed this

Sixth Day of December 1983

[SEAL]

Attest:

GERALD J. MOSSINGHOFF

Attesting Officer

Commissioner of Patents and Trademarks